United States Patent [19]

Justus

[11] 4,272,316

[45] Jun. 9, 1981

[54] STEAM SHOWER

[75] Inventor: Edgar J. Justus, Beloit, Wis.

[73] Assignee: Beloit Corporation, Beloit, Wis.

[21] Appl. No.: 43,002

[22] Filed: May 29, 1979

[51] Int. Cl.[3] ..... D21F 3/02

[52] U.S. Cl. ..... 162/206; 162/207

[58] Field of Search ..... 162/207, 290, 359, 206, 162/358; 100/37, 38, 74, 75, 93 RP, 118, 121, 153

[56] References Cited

U.S. PATENT DOCUMENTS

| | | | |
|---|---|---|---|
| 2,344,686 | 3/1944 | Fanselow | 34/18 |
| 2,711,591 | 6/1955 | Wellmar | 34/18 |
| 2,760,410 | 8/1956 | Gillis | 34/16 |
| 2,837,830 | 6/1958 | Fry et al. | 34/23 |
| 2,838,982 | 6/1958 | Dupasquier | 162/290 |
| 3,056,213 | 10/1962 | Kellogg | 34/23 |
| 3,183,606 | 5/1965 | Gustafsson et al. | 34/70 |
| 3,560,333 | 2/1971 | Douglas et al. | 162/207 |
| 4,163,688 | 8/1979 | Kankaanpaa | 162/359 |

*Primary Examiner*—Peter Chin

*Attorney, Agent, or Firm*—Hill, Van Santen, Steadman, Chiara & Simpson

[57] ABSTRACT

The method and mechanism for removing water from a traveling paper web including carrying the web through a first nip and then immediately on the offrunning side of the nip blanketing the web surface with steam and carrying the web up along a suction roll holding the steam onto the surface of the web and causing it to permeate the web without air getting onto the web surface following the nip.

2 Claims, 1 Drawing Figure

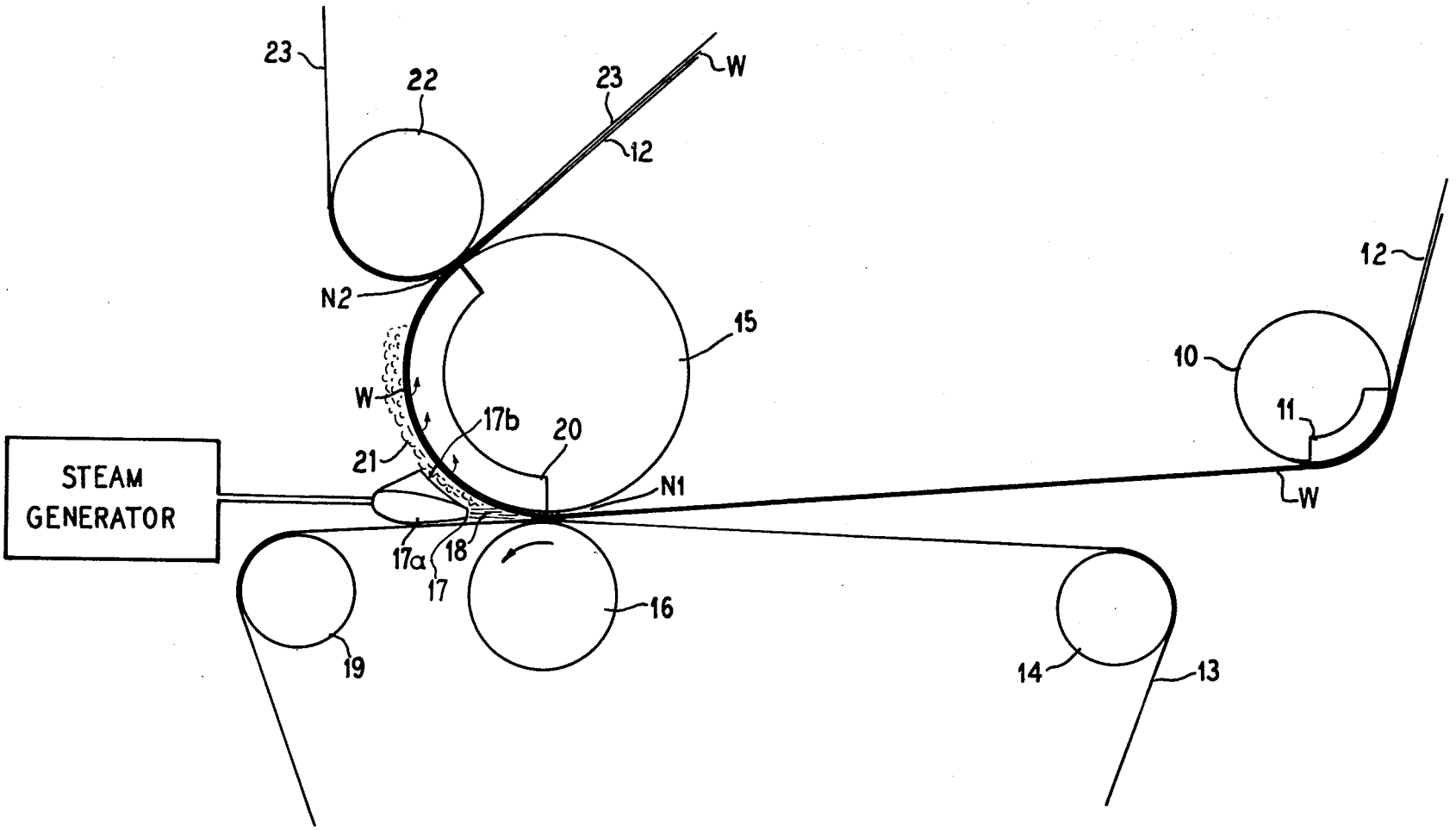
12
11
W
10
13
14
15
N1
16
W
23
12
20
17b
18
17
17a
22
21
W
N2
19
23
STEAM GENERATOR

STEAM SHOWER

BACKGROUND OF THE INVENTION

The present invention relates to improvements in paper making machines, and more particularly to improvements in press sections for paper making machines for improving the removal of water from a traveling web.

In pressing water from a traveling web in a press section, the water is expressed from the web by pressure between pressing surfaces such as the nip of a pair of press rolls and the water is expressed from the web by a pressure to cause it to travel into felts on which the web is supported. It has been heretofore appreciated that the removal of water from the web will be facilitated by lowering the viscosity of the water. Efforts have been made to improve the migration of the water from the web by heating the water or by heating the water within the web by subjecting it to heat before it enters the press nip or by blowing steam against the web to increase the water temperature. These methods of directing a flow of steam against the surface of the web increase the cost of processing because heat energy is required. Further, with the relatively high speed travel of the web in a modern paper making machine, the water either is not heated or is nonuniformly heated so that a successful increase in the ability of the water to travel from the web is not accomplished. Further, heat energy is lost with the steam escaping into the air and with air mixing with the steam in the dryer room, drafts and unequal air flow will result in an unequal effect on the heating of the water in the web.

It is an object of the present invention to provide an improved method and mechanism for a press section of a paper making machine wherein increased water removal can be accomplished.

A further object of the invention is to provide an improved method and mechanism wherein the viscosity of the water within a web is improved in a press section and the water in the web is affected uniformly with a minimum requirement for heat energy.

More particularly, the invention contemplates blanketing a surface of a web immediately on the offrunning side of a press section before the web is exposed to air and applying the web to the surface of a suction roll so that the steam is held onto and carried with the surface of the web and is drawn into the web due to the pressure differential across the web surface with the steam existing in a uniform layer on the surface of the web to the exclusion of air currents on the surface.

Other objects, advantages and features, as well as equivalent methods and structures which are intended to be covered herein, will become more apparent with the teaching of the principles of the present invention in connection with the disclosure of the preferred embodiment in the specification, claims and drawings, in which:

DRAWINGS

The single FIGURE of the drawings is a somewhat schematic side elevational view for a press section of a paper making machine constructed and operating with the principles of the present invention.

DESCRIPTION OF THE PREFERRED EMBODIMENT

As illustrated in the FIGURE of the drawings, a web W is received from a forming section of the machine carried on the surface of a felt 12. The felt passes down over a suction roll 10 with a suction gland 11 therein.

The web travels on the felt 12 toward a nip N-1. The web is carried between the upper felt 12 and a lower felt 13 through the nip. The felt 13 travels over a guide roll 14 entering the nip beneath the lower surface of the web. Water is expressed from the web in the press nip N-1 into the two felts, and the lower roll 16 of the press couple may be a solid roll or an open roll such as a roll with grooves.

The upper roll of the roll couple is shown at 15 as being an open suction roll and a suction gland 20 is positioned within the roll from the nip along the offrunning side extending to a succeeding nip N-2 formed between the suction roll 15 and another roll 22 which may be a solid roll or an open roll such as a grooved roll.

On the offrunning side of the nip N-1, the web separates from the lower felt 13, and the lower felt is led away from the nip, and travels over a guide roll 19.

A feature of the invention is the provision of a blanket of steam on the exposed surface of the web immediately following the offrunning side of the nip N-1. This blanket of steam excludes air from the surface of the web and is applied immediately on the offrunning side before the air can come in contact with the web surface.

The steam is applied by a steam shower or steam nozzle 17 which may be in the form of an elongated steam header 17*a* with a series of nozzles facing the nip to discharge steam into the nip against the exposed surface of the web W. Suitable means are provided for supplying steam to the header 17*a* and for example, the header may be connected to the steam supply for the steam drums to which the web normally is led immediately following the press section. It may be desirable to aid in confining the steam along the surface of the web as it travels past the nozzle 17 by a shield 17*b*. This shield is illustrated as extending for a short distance on the order of 20° to 27° of the circumference of the roll 15, but can be extended to be longer in certain instances.

When the web is blanketed with steam, a layer of steam extends along the full width of the web and it is carried forward along with the web and held to the surface of the web by the pressure differential which exists across the web surface due to the suction gland 20 within the open press roll 15. This layer or blanket of steam 21 follows the web as the web travels along the suction gland of the roll 15 and for the length of travel of the web between the nip N-1 and the nip N-2, the steam continues to permeate the web. No cold drafts of air or uneven exposure to the air can occur. Thus, as the steam permeates the web, the moisture within the web is uniformly heated reducing the viscosity of the moisture and making it easier for the moisture to travel out of the web. Also, as the steam is entering the web, a certain amount of moisture is being removed by the suction gland, but primarily the steam is applied for conditioning the water to be expressed in the second press nip N-2 between the rolls 15 and 22. Normally, the web will be carried between the felt 10 and an upper felt 23 through the second nip N-2.

Because the steam is applied to the web immediately on the offrunning side, it is given maximum time to heat the fibers of the web and the moisture within the web. Further, the heat of the steam is not diluted by being mixed with air either to waste the heat energy therein or to cause discrepancies in the amount of heat energy transferred to the web and nonuniform temperature of the water within the web. Primarily the steam is utilized to heat the moisture which is on the surface of the fibers, and a considerable saving in heat energy is effected as contrasted with methods wherein the entire pulp is heated or moisture within the pulp is heated. Further, the heat is applied in the second press so that the amount of moisture within the web has been diminished by the removal of moisture in the first press nip.

In operation, the web continues to travel at high speeds through the two nips and the quantity and pressure of steam directed into the nip can be regulated in accordance with the speed of travel of the web and the nature of the fibers and moisture carried with the web. The steam header 17 is made so that the nozzles direct a full blanket of steam to the exclusion of the surrounding air, and the header can be directed upwardly or downwardly in such a manner to insure that the steam remains in the gap or area on the offrunning side of the nip to form a traveling protective coat of steam over the outer exposed surface of the web, while the web is carried on its other surface over the suction roll. By increasing the water removal, the amount of water remaining in the web as it leaves the press is decreased, thus, decreasing the heat energy needed for the dryer drums and making it possible to eliminate drums from the dryer section.

Inasmuch as the steam is directed against the oncoming web and fills the V-shaped gap between the felt 13 and the web running on the suction roll, good exclusion of air from that area is attained and good permeation or mixing between the steam and the fibers of the web is insured. Further, since the steam is constantly present in the nip, as the web is released on the offrunning side of the nip, and tends to expand and separate the fibers, the steam is immediately drawn into the fibers by the slight elastic expansion of the web which occurs as it is released when it passes through the nip. This insures a good and uniform permeation of the steam into the fibers, and this initial permeation is encouraged and continued by the action of the suction on the opposite side of the web, as caused by the suction gland 20.

I claim as my invention:

1. The method of removing water from a traveling paper web, which comprises the steps of:

passing the web through a press nip for expressing water therefrom with a felt engaging a first surface of the web;

immediately blanketing a second, exposed surface of the web with steam on the offrunning side of the nip before the web is exposed to air and as the web and felt are being released from the offrunning side of the nip, and substantially completely blanketing the web from the offrunning side of the nip and for a substantial distance downstream from the nip and excluding air from direct contact with the steam covered web; and applying suction to the felt throughout said substantial distance downstream from the nip and drawing moisture from the web into the felt and drawing steam into the web.

2. The method of removing water from a traveling paper web in accordance with the steps of claim 1:

comprising confining the blanketing steam on said second surface of the web and immediately laying the web over a suction roll on the first surface, and causing the steam to permeate the web.

* * * * *